US006189504B1

(12) United States Patent
Israel et al.

(10) Patent No.: US 6,189,504 B1
(45) Date of Patent: Feb. 20, 2001

(54) SYSTEM FOR COMBINATION COMPRESSION RELEASE BRAKING AND EXHAUST GAS RECIRCULATION

(75) Inventors: Mark Israel, Amherst, MA (US); James Judd, Ellington, CT (US); Kristin V. Emmons, Newington, CT (US); Kevin J. Kinerson, Vernon, CT (US); Richard E. Vanderpoel, Bloomfield, CT (US)

(73) Assignee: Diesel Engine Retarders, Inc., Christiana, DE (US)

( * ) Notice: Under 35 U.S.C. 154(b), the term of this patent shall be extended for 0 days.

(21) Appl. No.: 09/198,522

(22) Filed: Nov. 24, 1998

Related U.S. Application Data

(60) Provisional application No. 60/066,412, filed on Nov. 24, 1997.

(51) Int. Cl.[7] ..... F02D 13/04

(52) U.S. Cl. ..... 123/321

(58) Field of Search ..... 123/320, 321, 123/323, 90.15, 90.16, 90.17

(56) References Cited

U.S. PATENT DOCUMENTS 5,787,859 * 8/1998 Meistrick et al. ..... 123/321
5,809,964 * 9/1998 Meistrick et al. ..... 123/321
6,012,424 * 1/2000 Meistrick ..... 123/321

* cited by examiner

*Primary Examiner*—Henry C. Yuen
*Assistant Examiner*—Hieu T. Vo
(74) *Attorney, Agent, or Firm*—David R. Yohannan; Collier Shannon Scott, PLLC

(57) ABSTRACT

An engine valve actuation system is disclosed, which is capable providing compression release engine braking in combination with exhaust gas recirculation while maintaining main exhaust and main intake valve events of constant magnitude during both positive power and engine braking. The system is also capable of providing a constant level of desired overlap between main exhaust and main intake valve events during both positive power and engine braking. The system may provide the foregoing functions by using first and second valve actuation subsystems to provide the full spectrum of exhaust valve motions. Both the first and second subsystems may receive an input motion from a valve train element. The first subsystem operates only when the engine braking system is enabled. The second subsystem operates both during positive power and during engine braking. When engine braking is enabled, the first and second subsystems work together to provide main exhaust, compression release and exhaust gas recirculation events. When the engine is in positive power mode, the second subsystem works alone, and is limited to providing main exhaust events. Methods of engine valve actuation are also disclosed.

15 Claims, 6 Drawing Sheets

SYSTEM FOR COMBINATION COMPRESSION RELEASE BRAKING AND EXHAUST GAS RECIRCULATION

CROSS-REFERENCE TO RELATED PATENT APPLICATION

This application relates to and claims priority on provisional application Ser. No. 60/066,412, filed on Nov. 24, 1997 and entitled "System For Combination Compression Release Braking And Exhaust Gas Recirculation".

FIELD OF THE INVENTION

The present invention relates generally to valve actuation in internal combustion engines that include compression release-type engine retarders. In particular, it relates to a valve actuation system that enables both compression release and exhaust gas recirculation valve actuation.

BACKGROUND OF THE INVENTION

Engine retarders of the compression release-type, also known as engine brakes, are well-known in the art. Engine retarders are designed to convert at least temporarily, an internal combustion engine of compression-ignition type into an air compressor. In doing so, the engine develops retarding horsepower to help slow the vehicle down. This can provide the operator increased control over the vehicle and substantially reduce wear on the service brakes of the vehicle. A properly designed and adjusted compression release engine retarder can develop retarding horsepower that is a substantial portion of the operating horsepower developed by the engine in positive power.

Functionally, compression release retarders supplement the braking capacity of the primary vehicle wheel braking system. In so doing, they may extend substantially the life of the primary (or wheel) braking system of the vehicle. The basic design for a compression release engine retarding system without exhaust gas recirculation is disclosed in Cummins, U.S. Pat. No. 3,220,392, issued November 1965.

The compression release engine retarder disclosed in the Cummins '392 patent employs a hydraulic system or linkage. The hydraulic linkage of the compression release engine retarder may be linked to the valve train of the engine. When the engine is under positive power, the hydraulic linkage may be disabled from providing the valve actuation that provides the compression release event. When compression release retarding is desired, the hydraulic linkage is enabled such that the compression release valve actuation is provided by the hydraulic linkage responsive to an input from the valve train.

Compression release occurs by opening the exhaust valve at a point near the end of a piston's compression stroke. In doing so, the work that is done in compressing the intake air cannot be recovered during the subsequent expansion (or power) stroke of the engine. Instead, it is dissipated through the exhaust and radiator systems of the engine. By dissipating energy developed from the work done in compressing the cylinder gases, the compression release retarder dissipates the kinetic energy of the vehicle, which may be used to slow the vehicle down.

Among the hydraulic linkages that have been employed to control valve actuation (both in braking and positive power), are so-called "lost-motion" systems. Lost-motion, per se, is not new. It has been known that lost-motion systems are useful for variable valve control for internal combustion engines. In general, lost-motion systems work by modifying the hydraulic or mechanical circuit connecting the actuator (typically the cam shaft) and the valve stem, to change the length of that circuit and lose a portion or all of the cam actuated motion that would otherwise be delivered to the valve stem to institute a valve opening event. In this way lost-motion systems may be used to vary valve event timing duration, and the valve lift.

Compression release engine retarders may employ a lost motion system in which a master piston engages the valve train (e.g. a push tube, cam, or rocker arm) of the engine. When the retarder is engaged, the valve train actuates the master piston, which is hydraulically connected to a slave piston. The motion of the master piston controls the motion of the slave piston, which in turn may open the exhaust valve of the internal combustion engine at the appropriate point to provide compression release valve events. In order to properly carry out the compression release events, it is necessary to reset (close) the valve in between the various valve events. If the valve is not reset, relatively small displacement events, such as compression release, may not be carried out.

One way of resetting the exhaust valve when using a unitary cam lobe for compression release valve events is to limit the motion of the slave piston which is responsible for pushing the valve into the cylinder during compression release events. A device that may be used to limit slave piston motion is disclosed in Cavanagh, U.S. Pat. No. 4,399,787 (Aug. 23, 1983) for an Engine Retarder Hydraulic Reset Mechanism, which is incorporated herein by reference. Another device that may be used to limit slave piston motion is disclosed in Hu, U.S. Pat. No. 5,201,290 (Apr. 13, 1993) for a Compression Relief Engine Retarder Clip Valve, which is also incorporated herein by reference. In theory, both of these valves (reset and clip) may comprise means for blocking a passage in a slave piston during the downward movement of the slave piston. After the slave piston reaches a threshold downward displacement, the reset valve or clip valve may unblock the passage through the slave piston and allow the oil displacing the slave piston to drain there through, causing the slave piston to return to its upper position under the influence of a return spring.

As the market for lost motion-type compression release retarders has developed, engine manufacturers have sought ways to improve compression release retarder performance and efficiency. Environmental restrictions, in particular, have forced engine manufacturers to explore a variety of new ways to improve the efficiency of their engines. These changes have forced a number of engine modifications. Engines have become smaller and more fuel efficient. Yet, the demands on retarder performance have often increased, requiring the compression release engine retarder to generate greater amounts of retarding horsepower under more limiting conditions.

The focus of engine retarder development has been toward a number of goals: securing higher retarding horsepower from the compression release retarder; working with, in some cases, lower masses of air deliverable to the cylinders through the intake system; and the inter-relation of various collateral or ancillary equipment, such as: silencers; turbochargers; and exhaust brakes. In addition, the market for compression release engine retarders has moved from the after-market, to original equipment manufacturers. Engine manufacturers have shown an increased willingness to make design modifications to their engines that would increase the performance and reliability and broaden the operating parameters of the compression release engine retarder.

One way of increasing the braking power of compression release engine retarders is to carry out exhaust gas recirculation (EGR) in combination with the compression release braking. Exhaust gas recirculation denotes the process of briefly opening the exhaust valve at the beginning of the compression stroke of the piston. Opening of the exhaust valve at this time permits higher pressure exhaust gas from the exhaust manifold to recirculate back into the cylinder. The recirculated exhaust gas increases the total gas mass in the cylinder at time of the subsequent compression release event, thereby increasing the braking effect realized by the compression release event.

It has been found that the exhaust gas recirculation event may be partially or totally lost as a result of unintentional resetting of the slave piston using a system that employs a Cavanagh type reset valve. Accordingly, there is a need for system, and method of operation thereof, that deactivates the reset for EGR events. There also remains a significant need for a system and method for controlling the actuation of the exhaust valve in order to increase the effectiveness of resetting to optimize the compression release retarding event.

A proposed system for carrying out compression release retarding and exhaust gas recirculation is disclosed in U.S. Pat. No. 5,146,890 to Gobert et al. ("Gobert"). The system disclosed in Gobert utilizes a two position device incorporated into the engine valve train between the cam and the valve stem. The device provides two distinct lash positions; one for positive power, and one for engine braking. During positive power the engine retarder is off, the device is retracted, and the relatively small compression release and exhaust gas recirculation events are "lost" due to the lash between the retracted device and the remainder of the valve train. When the engine retarder is turned on, the device extends to take up the lash in the valve train. Taking up the lash results in transmission of the compression release and exhaust gas recirculation lobes on the cam through the entire valve train to the valve stem.

FIG. 1 illustrates exhaust valve motion that occurs using the Gobert system during positive power (dashed line A) and during engine braking (broken line B). By taking up the lash during engine braking, the Gobert system produces a larger main exhaust valve event 50 than would otherwise be realized. The larger main exhaust event increases valve lift, duration, and increases the overlap between the main exhaust event 50 and the main intake event 60. The increase in exhaust-intake overlap is illustrated by shaded area 65 in FIG. 1. Increased overlap may be undesirable because it allows air that is normally trapped in the cylinder for a subsequent compression release event to escape from the cylinder past the open exhaust valve. A larger main exhaust event may also be undesirable because it could cause the exhaust valve to impact with the piston.

Gobert suggests that the increased overlap, that occurs inherently as a result of using the Gobert system, may be controlled by intentionally decreasing the size of the main exhaust and the main intake valve events during engine braking. See, column 2, lines 58–64 of Gobert. Hypothetically, the cam profiles could be reduced to produce main exhaust and main intake valve events of the desired magnitude during engine braking. With reference to FIG. 2, this change would inherently produce main exhaust 50 during positive power of lesser magnitude than the main exhaust event 50 during engine braking. Thus, if the main exhaust event is of the desired magnitude 54 during engine braking, then it is too small during positive power. If the main exhaust event is of the desired magnitude 52 during positive power, then it is too large during engine braking. A system is needed that can provide combination compression release and exhaust gas recirculation events and that can provide main exhaust and main intake events of a constant desired magnitude during positive power and engine braking.

OBJECTS OF THE INVENTION

It is therefore an object of the present invention to provide a system for combination compression release braking and exhaust gas recirculation.

It is another object to of the present invention to improve exhaust valve actuation for exhaust gas recirculation and compression release valve events.

It is another object of the present invention to provide a system that enables the use of a single cam profile for the exhaust gas recirculation, compression release, and main exhaust events for a particular exhaust valve.

It is a further object of the present invention to provide a system for compression release braking and exhaust gas recirculation that also provides main exhaust and main intake events of a desirable magnitude during positive power and engine braking.

It is yet a further object of the present invention to provide a system for compression release braking that does not substantially alter the overlap between the main exhaust event and the main intake event when switching between positive power and engine braking.

It is yet another object of the present invention to provide a slave piston that enables main exhaust, compression release, and exhaust gas recirculation valve events.

SUMMARY OF THE INVENTION

In response to this challenge, Applicants have developed an innovative and reliable system for providing compression release engine braking comprising: a means for providing a valve train motion; a first valve actuation subsystem for providing valve actuation for a full compression release event and valve actuation for an initial portion of a main exhaust event; and a second valve actuation subsystem for providing valve actuation for a latter portion of said main exhaust event.

Applicants have also developed an innovative method of providing compression release engine braking comprising: providing an engine braking valve train motion sufficient to produce lift required for a compression release event to a first valve actuation subsystem and a second valve actuation subsystem; providing full valve actuation for the compression release event using the first valve actuation subsystem; providing a main exhaust valve train motion sufficient to produce lift required for a main exhaust event to the first valve actuation subsystem and the second valve actuation subsystem; providing valve actuation for an initial portion of the main exhaust event using the first valve actuation subsystem; and providing valve actuation for a latter portion of the main exhaust event using the second valve actuation subsystem.

Applicants have further developed an innovative slave piston for use in the aforementioned system and method, comprising: an outer piston sleeve having an end wall and a side wall, said outer piston sleeve being adapted to be biased into a bore and adapted to be slidable within the bore; a first passage through the end wall of the outer piston sleeve and a second passage through the side wall of the outer piston sleeve, said second passage being adapted to communicate with an opening in the bore as a result of sliding displacement of the outer piston sleeve in a direction opposite to that of the direction in which the outer piston sleeve is adapted to be biased; means for selectively admitting fluid through said first passage into an interior portion of the outer piston sleeve; and an inner piston biased into and slidably disposed in the interior portion of the outer piston sleeve.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE PREFERRED EMBODIMENTS

Figure 3:
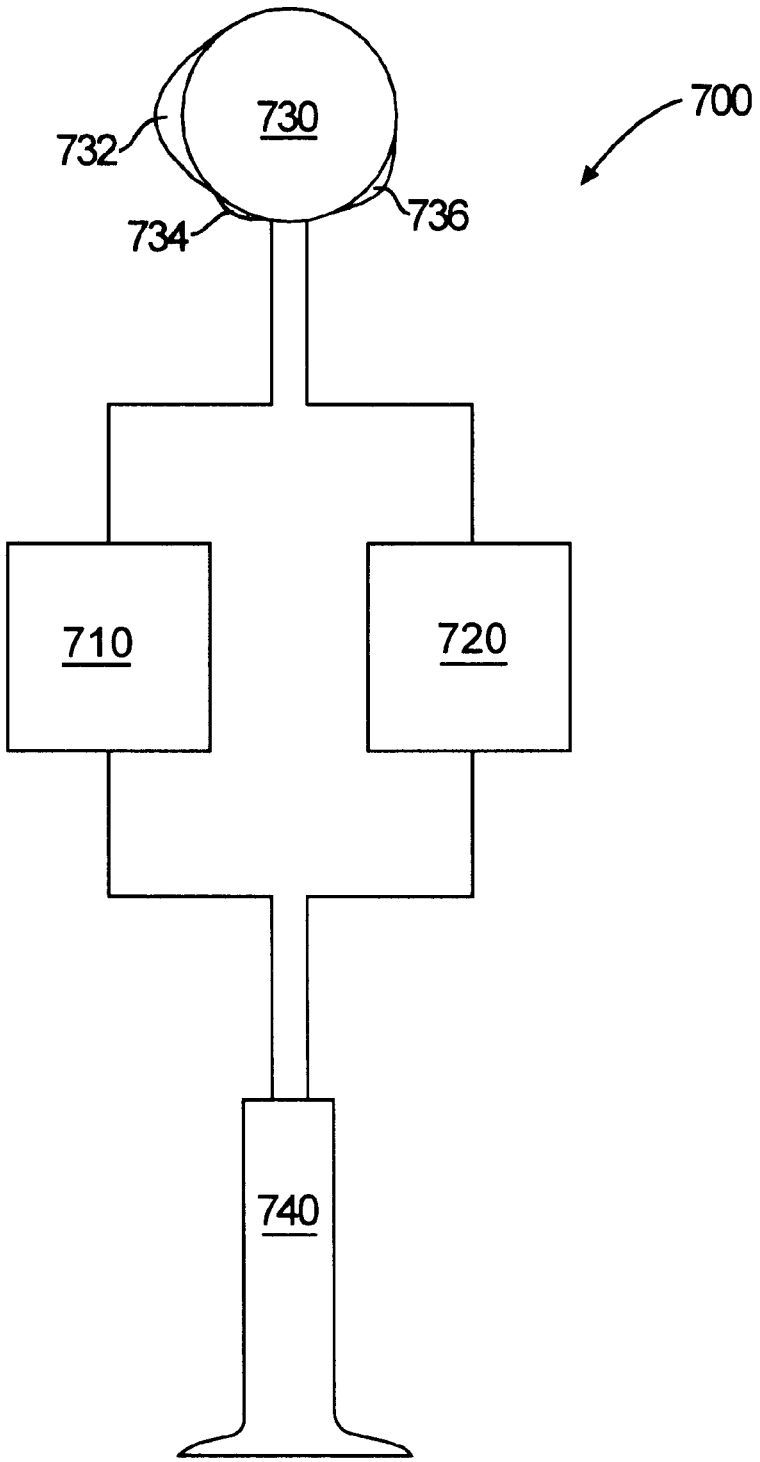
FIG. 3 is a schematic diagram of a system embodiment of the invention.

Reference will now be made in detail to a preferred embodiment of the present invention, an example of which is illustrated in the accompanying drawings. With reference to FIG. 3, the system 700 of an embodiment of the present invention is capable of maintaining main exhaust and main intake valve events of constant magnitude during both positive power and engine braking. The system is also capable of providing the desired overlap between main exhaust and main intake valve events during both positive power and engine braking. Furthermore, the system is capable of providing compression release engine braking in combination with exhaust gas recirculation while maintaining the aforementioned constant magnitude main exhaust and intake valve events.

The system 700 may provide these functions by using first and second valve actuation subsystems, 710 and 720 respectively, to provide the full spectrum of exhaust valve motions. Both the first and second subsystems 710 and 720, may receive an input motion from a means for providing valve train motion, such as the cam 730, in an engine valve train. The cam 730 may include lobes for a main exhaust event 732, a compression release event 734, and an exhaust gas recirculation event 736.

The slave pistons 10 and 20 described below with reference to FIGS. 4–12 are two particular embodiments of the first valve actuation subsystem 710. The first subsystem 710 operates only when the engine braking system is enabled. The second subsystem operates both during positive power and during engine braking. When engine braking is enabled, the first and second subsystems work together to provide main exhaust, compression release, and exhaust gas recirculation events. When the engine is in positive power mode, the second subsystem works alone, and is limited to providing main exhaust events.

Figure 1:
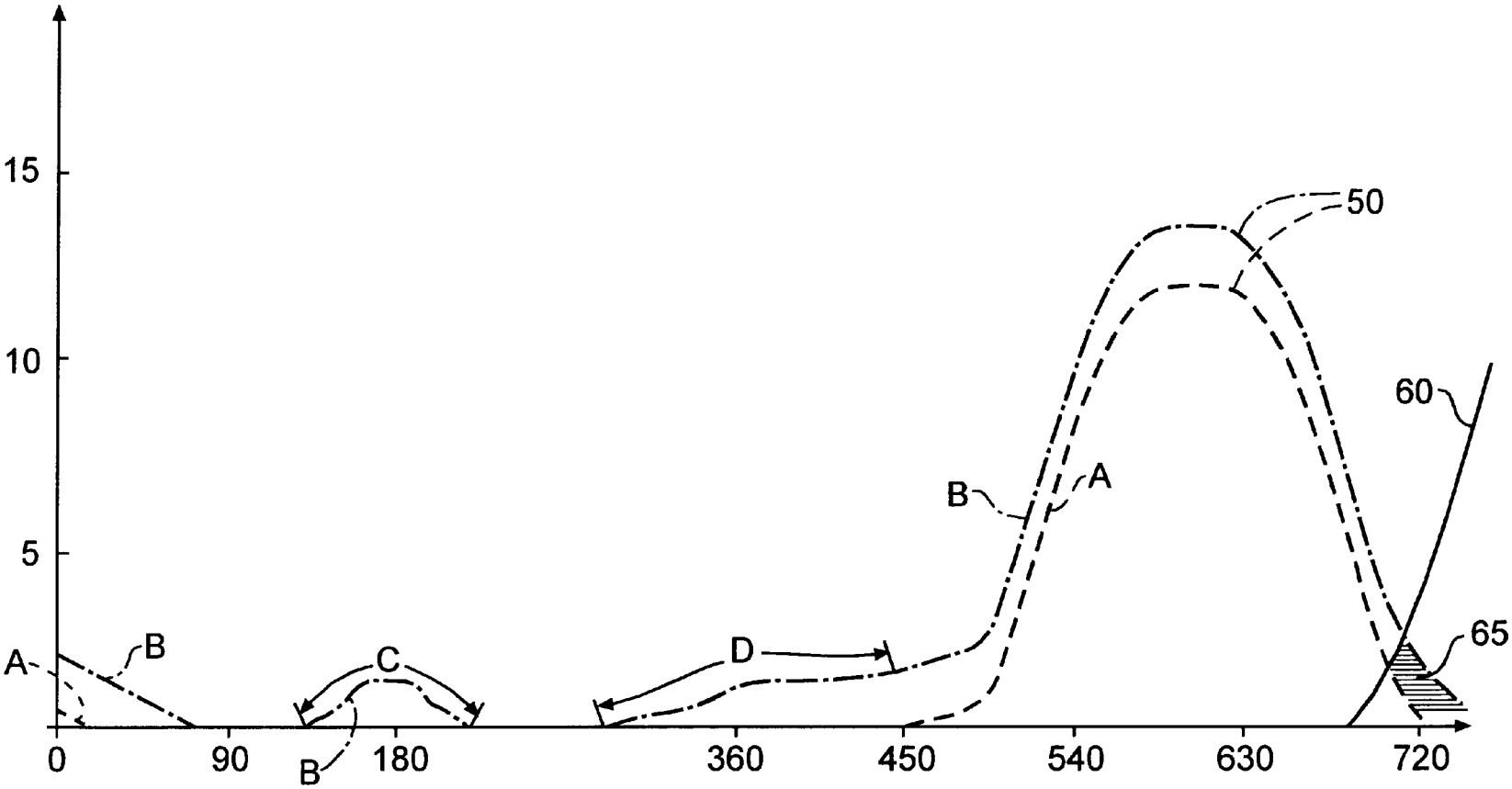
FIG. 1 is a graph illustrating valve motion for a known valve actuation system.
Figure 2:
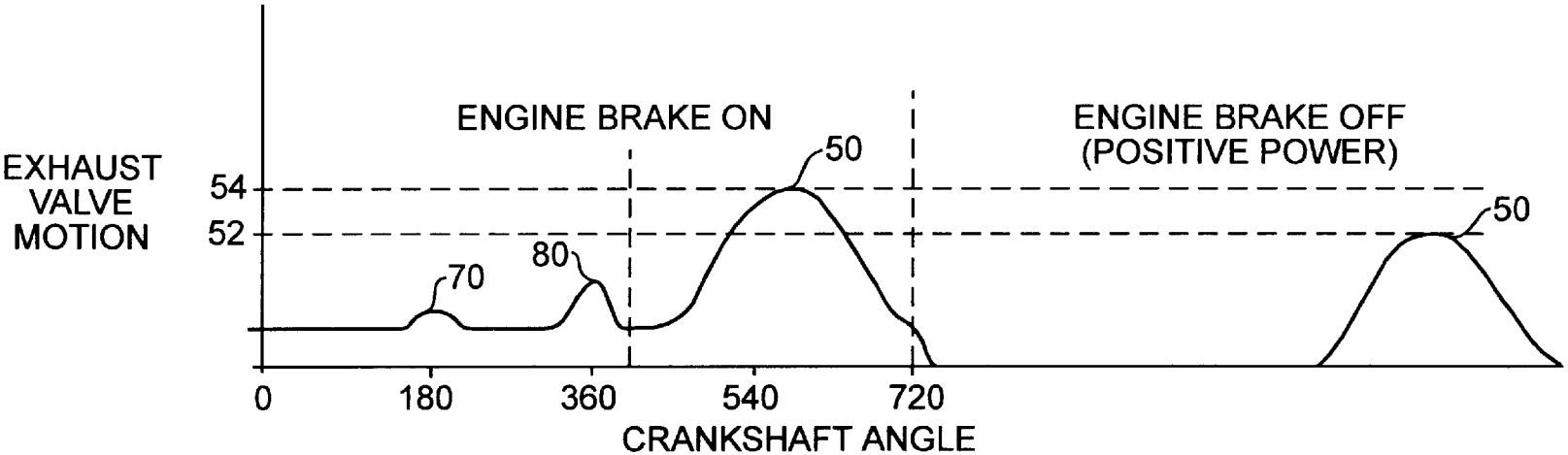
FIG. 2 is a graph illustrating comparative exhaust valve motion for a known valve actuation system during engine braking and positive power.
Figure 13:
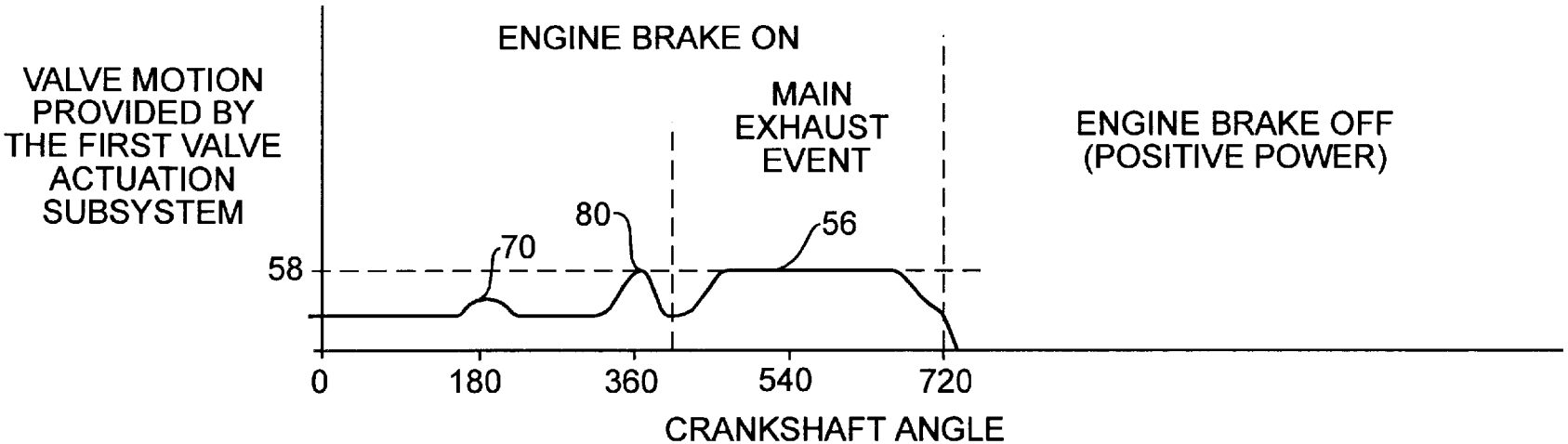
FIG. 13 is a graph illustrating exhaust valve actuation provided by a first valve actuation subsystem in a preferred embodiment of the invention.

During engine braking, the motion contributed by the first subsystem 710 to the overall motion of exhaust valve 740 is illustrated by the left half of the graph in FIG. 13. With reference to FIG. 13, the first subsystem may be limited to providing exhaust valve lift no greater than the lift called for by a compression release valve event (as indicated by dashed line 58). Accordingly, the first subsystem may provide the full valve actuation for the compression release 80 and the exhaust gas recirculation 70 events. The first subsystem may also provide the actuation 56 responsible for initially opening the exhaust valve during a main exhaust event.

The second subsystem contributes only to main exhaust events. The second subsystem may be embodied by a mechanical, hydraulic, electro-mechanical, or other subsystem. During engine braking, the second subsystem provides the additional lift required to complete the main exhaust event starting from the point the first subsystem left off (i.e., starting from event 56 in FIG. 13). When the engine is in positive power mode, as opposed to engine braking mode, the first subsystem is disabled, as shown by the later half of FIG. 13. At this time, the second subsystem may provide the entire motion required for the main exhaust event. Thus, the magnitude of the main exhaust event remains the same whether or not the first subsystem contributes to the overall event.

Figures 4, 5, 6, 7:
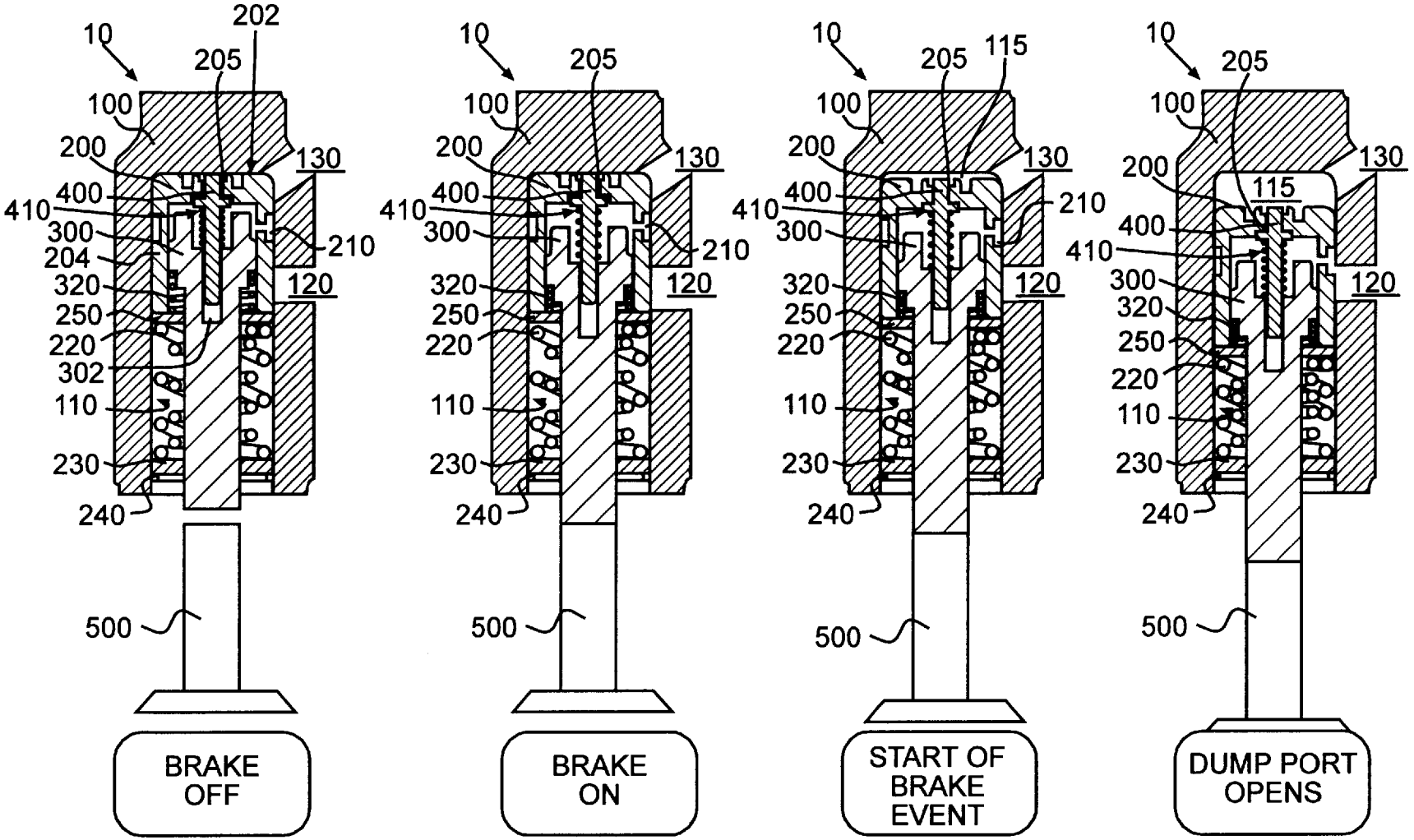
FIG. 4 is a cross-section in elevation of a slave piston embodiment of the invention in a brake off position.
FIG. 5 is a cross-section in elevation of the slave piston of FIG. 4 in a brake on position.
FIG. 6 is a cross-section in elevation of the slave piston of FIG. 4 in a start of compression release brake event position.
FIG. 7 is a cross-section in elevation of the slave piston of FIG. 4 in a dump port open position.

A preferred embodiment for carrying out the present invention is shown in FIG. 4 as slave piston 10. Slave piston 10 may provide the function of the above referenced first valve actuation subsystem and may include an outer piston sleeve 200, an inner piston 300, and a check valve 400, all of which are contained in the bore 110 of housing 100.

Outer piston sleeve 200 may have an end wall 202 and a side wall 204. The outer piston sleeve 200 may be dimensioned so as to form a seal with the housing 100 while at the same time being slidable within the bore 110. The outer piston sleeve 200 may be biased into the bore 110 by one or more springs 220. The springs 220 bias the outer piston sleeve 200 into the bore by applying pressure to a retaining washer 250, which in turn applies biasing pressure to the outer piston sleeve.

The outer piston sleeve 200 may include a first passage 205 through the end wall 202 of the outer piston sleeve and a second passage 210 through the side wall 204 of the outer piston sleeve. The second passage 210 may be adapted to communicate with an opening 120 in the bore 110 as a result of sliding displacement of the outer piston sleeve in a direction opposite to that of the direction in which the outer piston sleeve is biased (i.e. sliding displacement in a downward direction, as shown in FIG. 4).

The inner piston 300 may be slidably received in the interior portion of the outer piston sleeve 200. The inner piston 300 may be biased into the interior portion of the outer piston sleeve by a spring 320. The spring 320 provides an upward biasing force on the inner piston 300 as a result of being compressed between a shoulder provided on the inner piston and the retaining washer 250.

The inner piston 300 may include a recess 302 for receiving a portion of the check valve 400 and a spring 410 used to bias the check valve 400 into a closed position. The first passage 205 may be blocked by the check valve 400 as a result of the check valve being biased upward by the spring 410 into the first passage. When the check valve 401) is biased into a closed position, shoulders provided on the check valve may seal the first passage 205 so that fluid is blocked from flowing between the exterior portion 115 (shown in FIG. 7) of the outer piston sleeve 200 and the interior portion 215 (shown in FIG. 7). The shoulders on the check valve 400 may be provided in the interior portion 215 of the outer piston sleeve so that fluid may flow into the interior portion through first passage 205, but not flow out of the interior portion through the first passage. Depression of the check valve 400 further into the interior portion 215 provides for selective admission of fluid through the first passage 205 into an interior portion 215 of the outer piston sleeve.

As shown in FIG. 4, when the compression release retarder is off, the springs 220, 320, and 410 bias the outer piston sleeve 200, the inner piston 300, and the check valve 400, respectively, into a position away from the engine valve 500. When both the outer piston sleeve 200 and the check valve 400 are biased into their upmost positions, contact between the upper end of the check valve 400 and the end of the bore 110 cause the check valve to be cracked open against the closing biasing force of the check valve spring 410.

With reference to FIG. 5, when the retarder is turned on, low pressure hydraulic fluid (e.g. oil) is provided to the slave piston 10 through master piston connection 130. Oil provided through connection 130 flows into the upper portion of bore 110 and past check valve 400 (which is cracked open) into the outer piston sleeve interior portion 215. The pressure in the interior portion 215 may overcome the biasing force of the inner piston spring 320, causing the inner piston 300 to slide downward relative to the outer piston sleeve 200 until the inner piston contacts the valve 500. In this manner the lash between the inner piston 300 and the valve 500 can be taken up. The foregoing extension of the inner piston 300 into contact with the valve 500 may occur while the unitary cam (not shown) associated with the slave piston 10 is at base circle.

With reference to FIG. 6, as the compression release lobe on the cam displaces the master piston (not shown), the associated oil pressure increases and may cause the outer piston sleeve 200 to be displaced downward toward the valve 500. The downward displacement of the outer piston sleeve 200 may cause the check valve 400 to close under the influence of the check valve spring 410. Trapping of the oil in the interior portion 215 results in the outer piston sleeve 200 and the inner piston 300 becoming hydraulically locked together as a single unit. The oil pressure in the external portion 115 may cause the outer piston sleeve 200 and the inner piston 300 to slide downward as a single unit, thereby carrying out the compression release event by opening valve 500.

With reference to FIG. 7, the inner piston 300 and the outer piston sleeve 200 may complete their downward stroke together until communication is established between the outer piston sleeve spill port 210 and the housing spill port 120. Communication between the sleeve spill port 210 and the housing spill port 120 allows the oil in the interior portion 215 to drain from the slave piston through housing spill port 120.

Figures 8, 9, 10, 11:
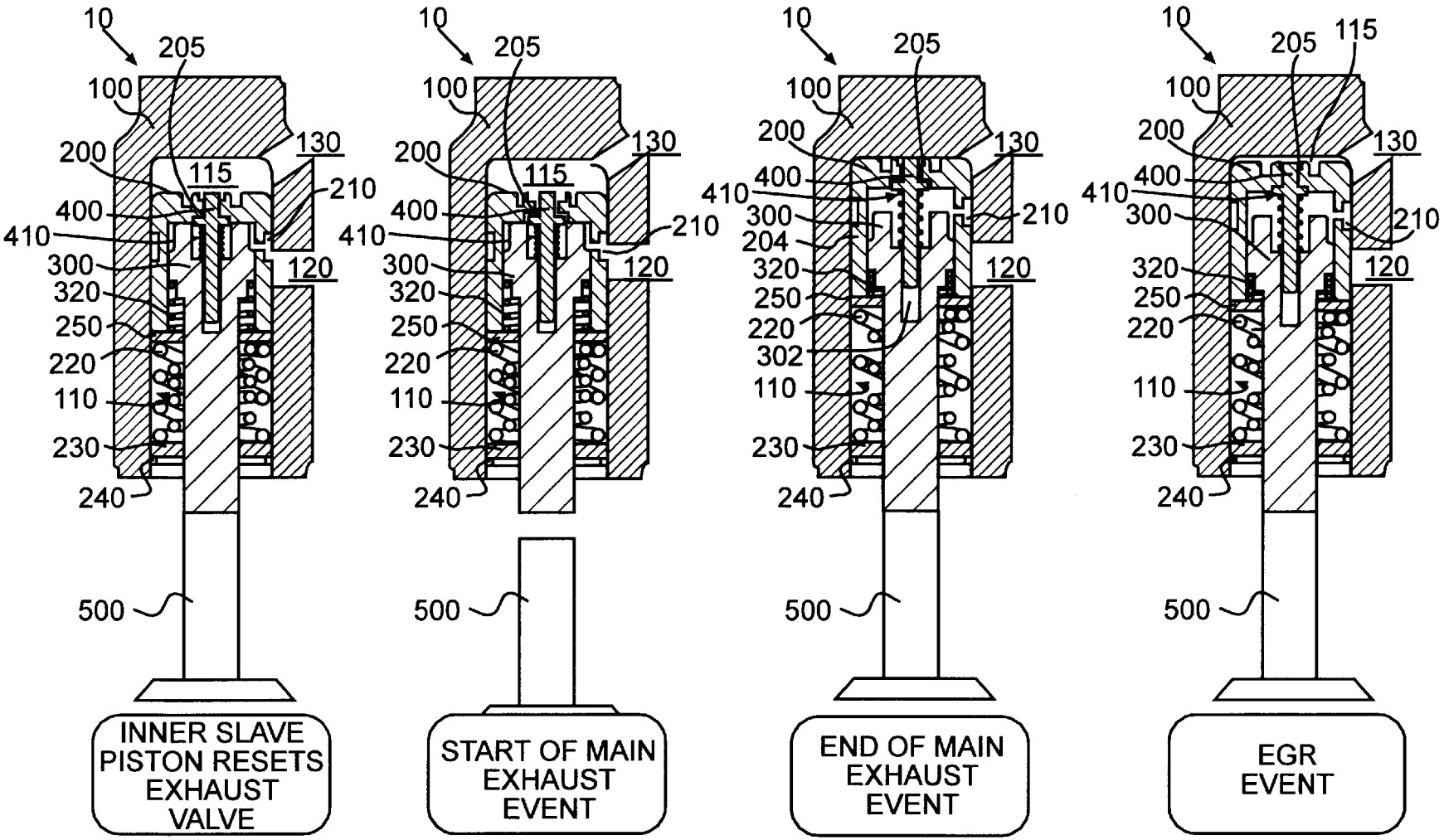
FIG. 8 is a cross-section in elevation of the slave piston of FIG. 4 in an inner slave piston reset position.
FIG. 9 is a cross-section in elevation of the slave piston of FIG. 4 in a start of main exhaust event position.
FIG. 10 is a cross-section in elevation of the slave piston of FIG. 4 in an end of main exhaust event position.
FIG. 11 is a cross-section in elevation of the slave piston of FIG. 4 in an EGR event position.

With reference to FIG. 8, as the oil drains through housing spill port 120, the inner piston 300 retracts upward until it seats against outer piston sleeve 200 (i.e. until the inner piston is reset). Stroke limiting of the slave piston 10 may be achieved by selective placement of the sleeve spill port 210 and the housing spill port 120 in their respective elements. The farther the outer piston sleeve 200 needs to travel to attain communication between the sleeve spill port 210 and the housing spill port 120, the longer the slave piston stroke will be for the compression release event.

With reference to FIG. 9, during the main exhaust valve event, oil may continue to enter the slave piston 10 through master piston connection 130, and to drain through the sleeve spill port 210 and the housing spill port 120, thereby keeping the inner piston 300 in a steady position seated against the outer piston sleeve 200. The valve 500 may move out of contact with the inner piston 300 because the main exhaust motion imparted to the valve through the positive power valve train (i.e., the second valve actuation subsystem which is not shown) surpasses the limited downward stroke of the slave piston 10.

With reference to FIG. 10, at the end of the main exhaust event, oil flow into connection 130 may cease, and the outer piston sleeve 200 may slide up into contact with the end of bore 110 under the influence of the spring 220. When the outer piston sleeve 200 is fully retracted into the bore 110, contact between the upper end of the check valve 400 and the end of the bore 110 may result in a small downward displacement of the check valve. The small downward displacement of the check valve 400 permits oil to flow into the interior portion 215, so that any lash between the inner piston 300 and the valve 500 may be taken up.

With reference to FIG. 11, as the exhaust gas recirculation lobe on the cam displaces the master piston (not shown), the associated oil pressure may cause the outer piston sleeve 200 to be displaced downward toward the valve 500. The downward displacement of the outer piston sleeve 200 may cause the check valve 400 to close under the influence of the check valve spring 410. When the check valve 400 closes, the outer piston sleeve 200 and the inner piston 300 may be hydraulically locked together as a single unit. The oil pressure in the external portion 115 may cause the outer piston sleeve 200 and the inner piston 300 to slide downward as a single unit, thereby carrying out the exhaust gas recirculation event by opening valve 500. The downward movement of the outer piston sleeve 200 may not be great enough during exhaust gas recirculation to create communication between the sleeve spill port 210 and the housing spill port 120. After the exhaust gas recirculation event, the slave piston 10 may return to the "brake on" position shown in FIG. 3.

Figure 12:
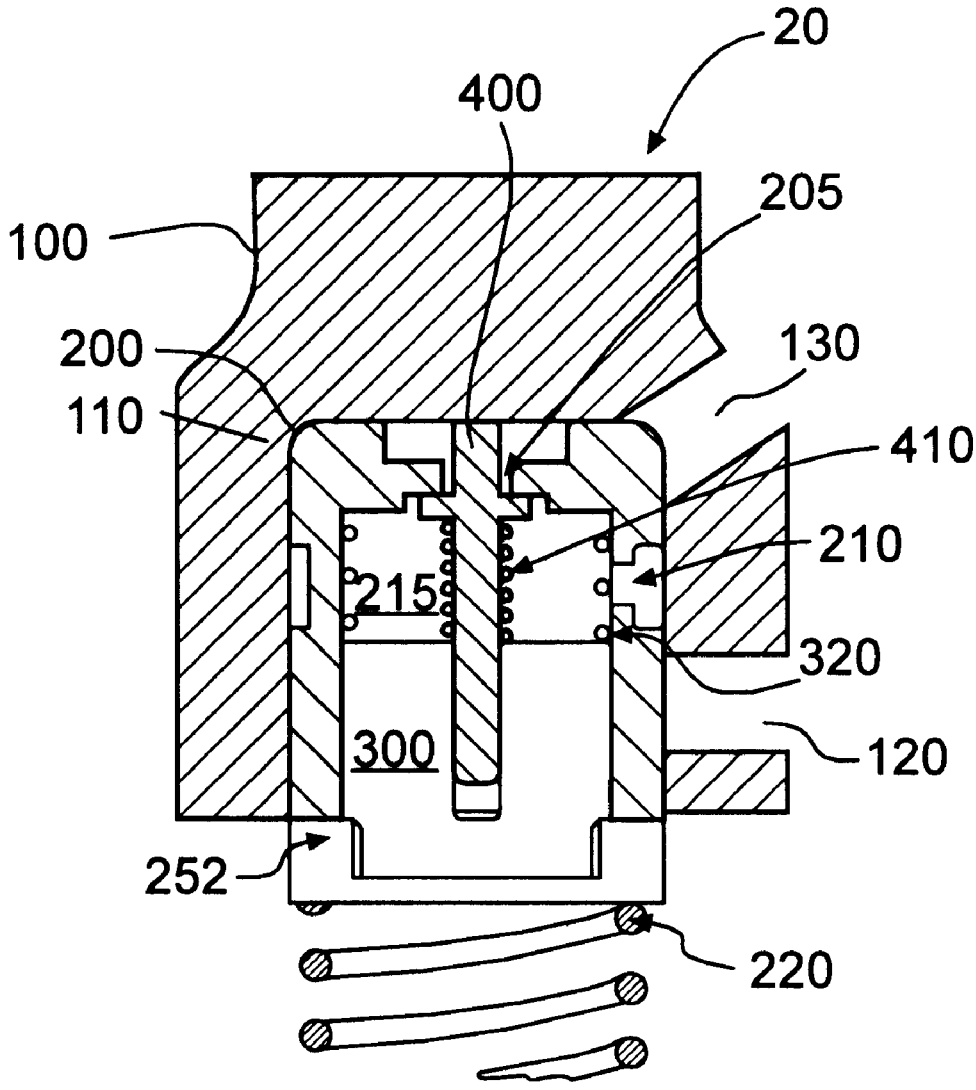
FIG. 12 is a cross-section in elevation of an alternative slave piston embodiment of the invention.

Slave piston 20, shown in FIG. 12, is an alternative embodiment of the invention. Slave piston 20 functions in the same manner as slave piston 10 shown in FIGS. 4–11, and like reference numerals refer to like elements. In slave piston 20 the inner piston spring 320 may be located in the interior portion 215 between the outer piston sleeve 200 and the inner piston 300. Inner piston spring 320 may be provided in compression between the outer piston sleeve 200 and the inner piston 300. Both inner piston 300 and outer piston sleeve 200 may be biased upward by one or more springs 220 (which may comprise a torsion spring with a lever arm in contact with the yoke 252) applying pressure to a retaining yoke 252. The retaining yoke 252 may press the outer piston sleeve 200 into contact with the end of the bore 110. The retaining yoke 252 also presses against a shoulder on the inner piston 300 so that the inner piston shoulder is aligned with the bottom of the outer piston sleeve 200.

With continued reference to FIG. 12, in which like reference numerals refer to like elements to those shown in FIGS. 4–11, when the retarder is turned on, low pressure oil may be provided to the slave piston 20 through master piston connection 130. Low pressure oil provided through connection 130 may flow into the upper portion of bore 110 and past check valve 400 (which is cracked open) into the outer piston sleeve interior portion 215. The pressure in the interior portion 215 may overcome the biasing force of the spring 220, causing the inner piston 300 to slide downward relative to the outer piston sleeve 200 until the yoke 252 contacts the valve stem (not shown). In this manner the lash between the yoke 252 and the valve stem can be taken up. The foregoing extension of the inner piston 300 and yoke 252 into contact with the valve stem may occur while the unitary cam (not shown) associated with the slave piston 20 is at base circle.

As the compression release lobe on the earn displaces the master piston (not shown), high pressure oil may cause the outer piston sleeve 200 to be displaced downward toward the valve 500. As the outer piston sleeve 200 moves downward the outer piston sleeve and the inner piston 300 may become hydraulically locked together as a single unit. The oil pressure applied to the outer piston sleeve 200 through connection 130 may cause the outer piston sleeve 200 and the inner piston 300 to slide downward as a single unit, thereby carrying out the compression release event by opening the exhaust valve. When the outer piston sleeve 200 is sufficiently displaced downward, the high pressure oil in the interior portion 215 may drain out of the slave piston 20 through housing spill port 120.

It will be apparent to those skilled in the art that variations and modifications of the present invention can be made without departing from the scope or spirit of the invention. For example, the housing, outer piston sleeve, and inner piston contemplated as being within the scope of the invention include housings and pistons of any shape or size so long as the elements in combination provide the function of selective resetting of the slave piston. Furthermore, it is contemplated that the scope of the invention may extend to variations on the check valve used to check the flow of fluid into the interior of the slave piston and to variations on the shape, design and placement of the outer piston sleeve spill port and housing spill port. The invention also is not limited in use with a particular type of valve train (cams, rocker arms, push tubes, etc.). It is further contemplated that variations on the first valve actuation subsystem may be made without departing from the scope of the invention. Thus, it is intended that the present invention cover the modifications and variations of the invention, provided they come within the scope of the appended claims and their equivalents.

We claim:

1. A system for providing compression release engine braking for at least one engine valve said system comprising:

a means for providing a valve train motion;

a first valve actuation subsystem for providing valve actuation for a full compression release event and valve actuation for an initial portion of a main exhaust event during engine braking, said first valve actuation subsystem being operatively connected to the valve train motion means and the engine valve; and a second valve actuation subsystem for providing valve actuation for a latter portion of said main exhaust event during engine braking, said second valve actuation subsystem being operatively connected to the valve train motion means and the engine valve, wherein said first valve actuation subsystem includes a slave piston disposed in a bore comprising:

an outer piston sleeve slidably disposed and biased into the bore, said outer piston sleeve having an end wall and a side wall, and having a first passage through the end wall and a second passage through the side wall;

an inner piston slidably disposed within the outer piston sleeve;

an interior portion within the outer piston sleeve, said interior portion communicating with said first and second passages and being adapted to receive hydraulic fluid therein; and a check valve adapted to selectively block the first passage.

2. The system of claim 1 wherein said first valve actuation subsystem provides valve actuation for an exhaust gas recirculation event.

3. The system of claim 1 wherein a main exhaust event provided by a combination of the first valve actuation subsystem and the second valve actuation subsystem during engine braking is of substantially the same duration as a main exhaust event provided by the second valve actuation subsystem alone during positive power.

4. The system of claim 1 further comprising a means to bias the inner piston towards a position adapted to reduce the interior portion.

5. The system of claim 1 further comprising a means to bias the inner piston towards a position adapted to enlarge the interior portion.

6. The system of claim 1 further comprising a means to bias the check valve towards a position adapted to block the first passage.

7. The system of claim 1 wherein the check valve is cracked open thereby unblocking the first passage when the end wall of the outer piston sleeve contacts an end wall of the bore.

8. The system of claim 1 wherein the second passage is adapted to communicate with an opening in the bore when the outer piston sleeve is displaced within the bore.

9. A system for providing main exhaust and compression release valve events to an engine valve element in an internal combustion engine, comprising:

means for providing a valve train motion including a main exhaust and a compression release event;

first means for (a) providing a compression release valve event and, (b) providing an initial portion of a main exhaust event, responsive to the valve train motion means, said first means being operatively connected to the means for providing a valve train motion and the engine valve element; and second means for (a) providing a latter portion of the main exhaust event and (b), absorbing compression release motion, responsive to the valve train motion means, said second means being operatively connected to the means for providing a valve train motion and the engine valve element, wherein said first means comprises:

an outer piston sleeve having an end wall and a side wall, said outer piston sleeve being adapted to be biased into a bore and adapted to be slidable within the bore;

a first passage through the end wall of the outer piston sleeve and a second passage through the side wall of the outer piston sleeve, said second passage being adapted to communicate with an opening in the bore as a result of sliding displacement of the outer piston sleeve in a direction opposite to that of the direction in which the outer piston sleeve is adapted to be biased;

means for selectively admitting fluid through said first passage into an interior portion of the outer piston sleeve; and an inner piston biased into and slidably disposed in the interior portion of the outer piston sleeve.

10. A system for providing internal combustion engine valve actuation comprising:

a positive power valve train linkage for transferring a valve opening motion from a cam profile to an engine valve, said positive power linkage having a lash sufficient to absorb compression release events and exhaust gas recirculation events provided by said cam profile;

a braking valve train linkage for transferring a valve opening motion from said cam profile to said engine valve, said braking linkage including a hydraulically actuated slave piston for providing braking events selected from the group consisting of: compression release events and exhaust gas recirculation events; and wherein said slave piston comprises, an outer piston sleeve slidably disposed and biased into a slave piston housing, said outer piston sleeve having an end wall and a side wall, and having a first passage through the end wall and a second passage through the side wall;

an inner piston slidably disposed within the outer piston sleeve;

an interior portion within the outer piston sleeve, said interior portion communicating with said first and second passages and being adapted to receive hydraulic fluid therein;

a check valve adapted to selectively block the first passage; and a means to bias the check valve towards a position adapted to block the first passage, wherein said check valve includes an upper end adapted to cause the check valve to be cracked open against the bias of the means to bias the check valve.

11. The system of claim 10 further comprising a means to bias the inner piston towards a position adapted to reduce the interior portion.

12. The system of claim 10 further comprising a means to bias the inner piston towards a position adapted to enlarge the interior portion.

13. The system of claim 10 wherein the check valve is cracked open when the end wall of the outer piston sleeve contacts an end wall of the slave piston housing, thereby unblocking the first passage.

14. The system of claim 13 wherein the second passage is adapted to communicate with an opening in the slave piston housing when the outer piston sleeve is out of contact with the end wall of the slave piston housing.

15. A method of providing compression release engine braking comprising:

providing an engine braking valve train motion sufficient to produce lift required for a compression release event to a first valve actuation subsystem and a second valve actuation subsystem;

providing full valve actuation for the compression release event using the first valve actuation subsystem;

providing a main exhaust valve train motion sufficient to produce lift required for a main exhaust event to the first valve actuation subsystem and the second valve actuation subsystem;

providing valve actuation for an initial portion of the main exhaust event using the first valve actuation subsystem; and providing valve actuation for a latter portion of the main exhaust event using the second valve actuation subsystem.

* * * * *